US009598254B2

(12) United States Patent
Gentile et al.

(10) Patent No.: US 9,598,254 B2
(45) Date of Patent: Mar. 21, 2017

(54) ROLL TYPE MATERIAL FEEDING APPARATUS AND METHOD

(75) Inventors: Joseph P. Gentile, Longboat Key, FL (US); Vaughn H. Martin, Mars, PA (US); Bryan P. Gentile, Longboat Key, FL (US)

(73) Assignee: VAMCO INTERNATIONAL, INC, Pittsburgh, PA (US)

( * ) Notice: Subject to any disclaimer, the term of this patent is extended or adjusted under 35 U.S.C. 154(b) by 695 days.

(21) Appl. No.: 13/818,308

(22) PCT Filed: Aug. 22, 2011

(86) PCT No.: PCT/US2011/048624

§ 371 (c)(1),
(2), (4) Date: May 17, 2013

(87) PCT Pub. No.: WO2012/027273

PCT Pub. Date: Mar. 1, 2012

(65) Prior Publication Data

US 2015/0298188 A1 Oct. 22, 2015

Related U.S. Application Data

(60) Provisional application No. 61/376,025, filed on Aug. 23, 2010.

(51) Int. Cl.
*B65H 20/04* (2006.01)
*B21D 43/09* (2006.01)

(52) U.S. Cl.
CPC ..... *B65H 20/04* (2013.01); *B21D 43/09* (2013.01)

(58) Field of Classification Search
CPC ..... B65H 20/16; B65H 20/18; B65H 20/04; B21B 39/02; B21D 43/08; B21D 43/09
See application file for complete search history.

(56) References Cited

U.S. PATENT DOCUMENTS

| | | | |
|---|---|---|---|
| 4,032,056 | A | 6/1977 | Ito |
| 4,161,862 | A | 7/1979 | Hartmannsgruber et al. |
| 4,314,388 | A | 2/1982 | artmannsgruber et al. |
| 4,434,924 | A | 3/1984 | Varisco |
| 4,798,116 | A | 1/1989 | Silver et al. |

(Continued)

FOREIGN PATENT DOCUMENTS

| | | |
|---|---|---|
| CN | 2418979 | 2/2001 |
| CN | 101422800 | 5/2009 |

(Continued)

OTHER PUBLICATIONS

Machine translation of CN2418979, retreived Apr. 15, 2016.*

(Continued)

*Primary Examiner* — Michael McCullough
(74) *Attorney, Agent, or Firm* — Cheryl L. Gastineau; Reed Smith LLP

(57) ABSTRACT

A roll type material feeding apparatus for intermittently feeding a workpiece such as a strip-like sheet material, to a stamping machine or similar machine. The apparatus includes a frame, a first driven feed roll, a second feed roll, a first drive motor arranged to rotate in driving engagement with the first driven feed roll, a first rotary position sensor arranged to rotate in driving engagement with the first drive motor, and a second drive motor.

25 Claims, 7 Drawing Sheets

(56) References Cited

U.S. PATENT DOCUMENTS

| | | | |
|---|---|---|---|
| 5,042,645 | A | 8/1991 | Pritchard |
| 5,145,169 | A | 9/1992 | Kato |
| 5,356,062 | A | 10/1994 | Kato |
| 5,720,378 | A | 2/1998 | Fasoli |
| 5,808,465 | A | 9/1998 | Gentile et al. |
| 2003/0183059 | A1 | 10/2003 | Eigenmann |
| 2007/0085499 | A1 | 4/2007 | Gianone |
| 2010/0179686 | A1 | 7/2010 | Carlson et al. |

FOREIGN PATENT DOCUMENTS

| | | |
|---|---|---|
| CN | 201271710 | 7/2009 |
| JP | 03014021 | 2/1991 |
| JP | 04181965 | 6/1992 |
| JP | 170637 | 6/1994 |
| JP | 2004001078 | 1/2004 |
| JP | 2005271070 | 10/2005 |
| JP | 2006-181642 | 7/2006 |
| WO | 2009097402 | 8/2009 |

OTHER PUBLICATIONS

First Office Action received from the Republic of China for corresponding Chinese Application No. 201180048932.8 dated Aug. 13, 2014.

Search Report and Written Opinion for corresponding International Application No. PCT/US2011/48624 dated Jan. 31, 2012.

Second Office Action received from the Republic of China for corresponding Chinese Application No. 201180048932.8 dated May 29, 2015.

Translation of Japanese Office Action for Japanese Application No. 2013526068 dated Aug. 17, 2015.

Translation of Japanese Office Action for Japanese Application No. 2013526068 dated Apr. 11, 2016.

European Supplmental Search Report in European Patent Application No. 11820461.9 dated Dec. 14, 2016.

* cited by examiner

ROLL TYPE MATERIAL FEEDING APPARATUS AND METHOD

CROSS-REFERENCE TO RELATED APPLICATION

This application is a 371 National Stage of International Application No. PCT/US2011/048624, filed Aug. 22, 2011, which claims the benefit under 35 U.S.C. §119(e) of the earlier filing date of U.S. Provisional Application Ser. No. 61/376,025 filed on Aug. 23, 2010. The aforementioned patent applications are expressly incorporated herein by reference in their entirety.

FIELD OF INVENTION

The invention relates generally to a material feeding apparatus, and particularly to a roll type material feeding apparatus for intermittently feeding a workpiece such as a strip-like sheet material, to a stamping machine or similar machine.

BACKGROUND OF THE INVENTION

Existing roll type material feeding apparatus utilize a pair of rolls for gripping and intermittently feeding a workpiece between the rolls. Many such roll feeding apparatus utilize a high performance servo motor for rotating the rolls. An example of such an apparatus is represented by U.S. Pat. No. 5,808,465 issued to Gentile et. al. in 1998, the disclosure of which is incorporated by reference. The apparatus of U.S. Pat. No. 5,808,465 utilizes a high performance servo motor for rotating a pair of rolls for intermittently feeding a strip-like sheet material workpiece.

A first limitation of existing roll type material feeding apparatus results when the length of the rolls must be increased in order to accommodate wider strip-like workpieces. As roll width increases, roll inertia increases, thereby resulting in decreased performance levels or alternatively more powerful motors are required. In order to meet the demand for more powerful motors, two options are available. Increase the motor diameter, or increase the motor length. If the motor diameter is increased, the resulting motor will indeed be capable of producing more torque, however the inertia of the motor is increased, and the resulting performance gain of the overall system is small. If the motor length is increased, there becomes a practical limitation to the length increase due to constraints in winding the motor coils on motors with a high length-to-diameter ratio.

A second limitation of existing roll type material feeding apparatus results when the length of the rolls are increased in order to accommodate wider strip-like workpieces. As the roll width increases, the torsional stiffness of the rolls is decreased. As the torsional stiffness of the apparatus is decreased the accuracy of the feed apparatus is decreased due to wind-up or twist of the roll between the high performance servo motor that is driving the roll and the workpiece held between the rolls. Furthermore, the rate of intermittent feeding of the workpiece is reduced. The rate at which intermittent feeding can occur is limited by the ability of the high performance servo motor to controllably start and stop the movement of the rolls and subsequently the workpiece. The controllability of a high performance servo motor is in direct correlation to the stiffness of the system being controlled, in this case the rolls of the feeding apparatus.

Accordingly, the present invention provides an electric servo motor driven roll type feeding apparatus capable of high rates of intermittent feeding of a wide strip-like workpiece which utilizes low inertia motors with improved length-to-diameter ratios for improved manufacturability.

The present invention provides an electric servo motor driven roll type feeding apparatus capable of high rates of intermittent feeding of a wide strip-like workpiece with improved torsional stiffness and subsequently improved accuracy and controllability.

SUMMARY OF THE INVENTION

In one general aspect, this application discloses an apparatus for the intermittent feeding of a workpiece. Specifically, the apparatus includes a frame, a first driven feed roll, a second feed roll, a first drive motor arranged to rotate in driving engagement with the first driven feed roll, a first rotary position sensor arranged to rotate in driving engagement with the first drive motor, and a second drive motor.

BRIEF DESCRIPTION OF THE DRAWINGS

For the present invention to be clearly understood and readily practiced, the present invention will be described in conjunction with the following figures, wherein like reference characters designate the same or similar elements, which figures is incorporated into and constitutes a part of the specification, wherein.

DETAILED DESCRIPTION OF THE DRAWINGS

Figure 1:
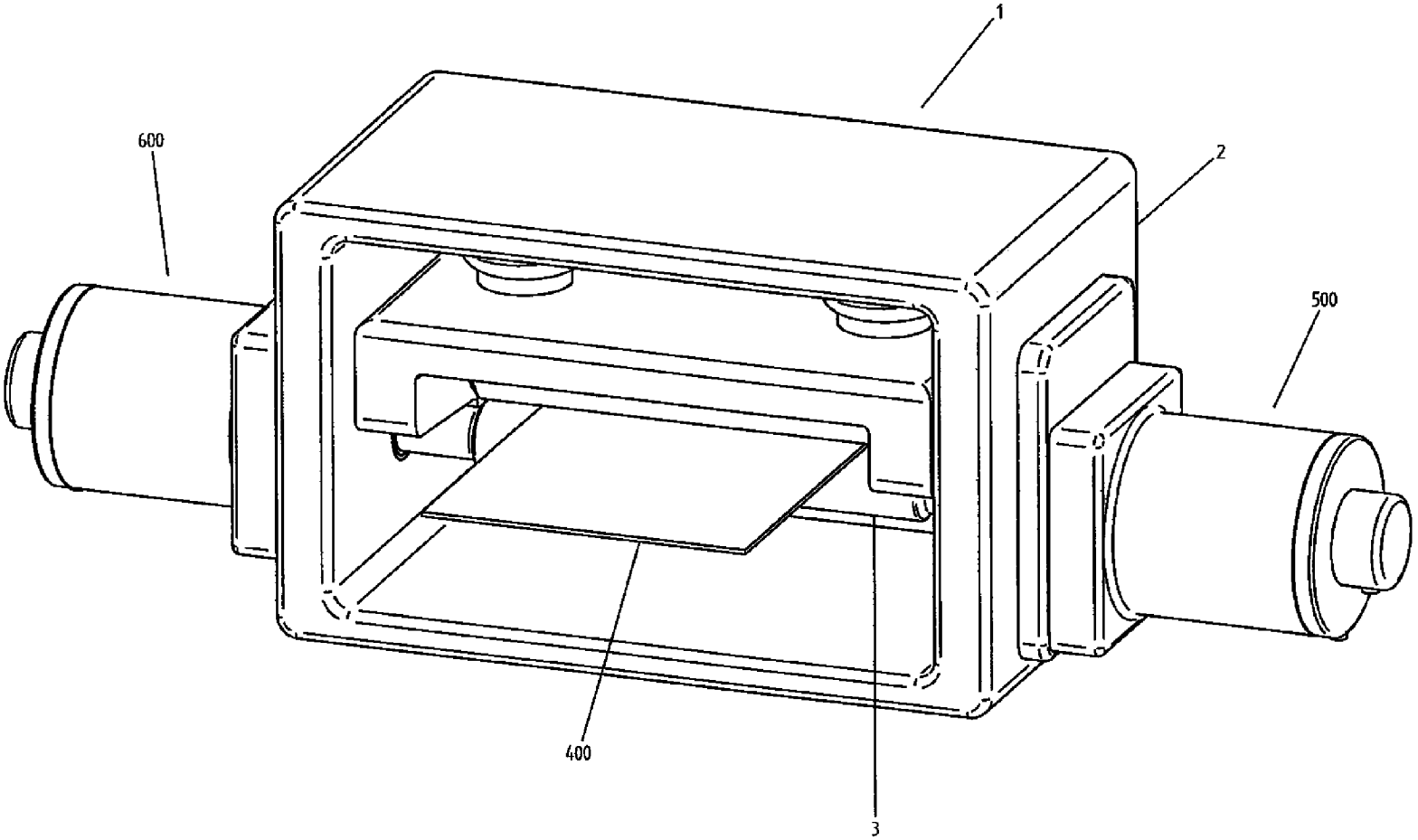
FIG. 1 is a front perspective view of a roll type material feeding apparatus according to an embodiment of the invention.
Figure 2:
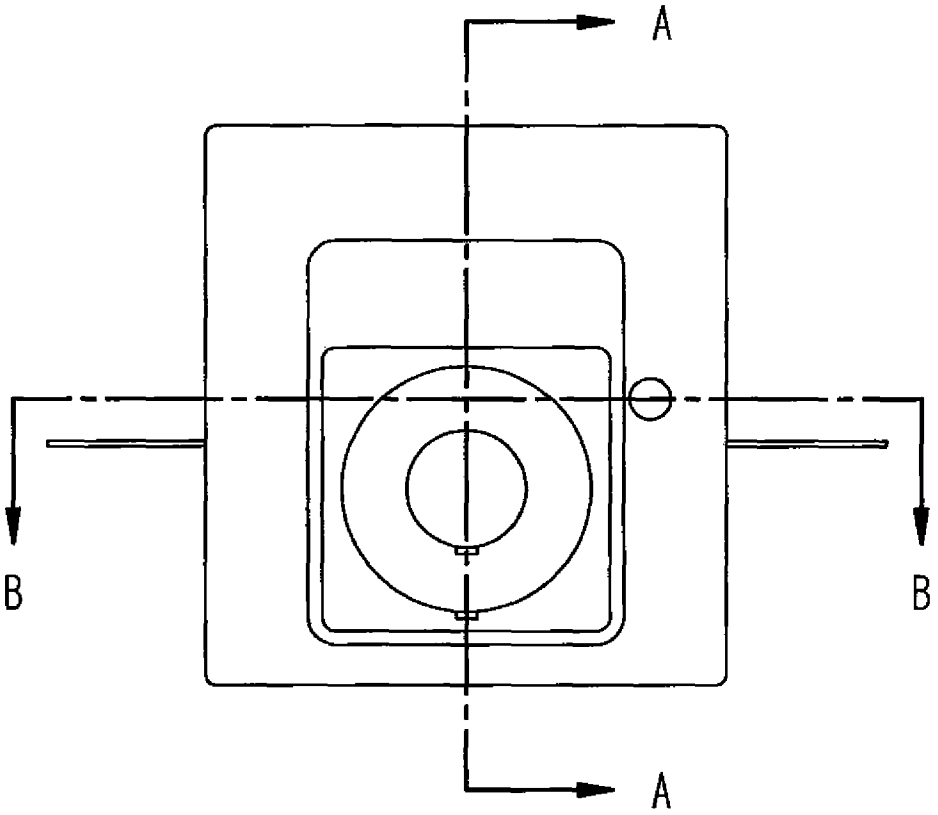
FIG. 2 is a side view of a roll type material feeding apparatus according to an embodiment of the invention.
Figure 3:
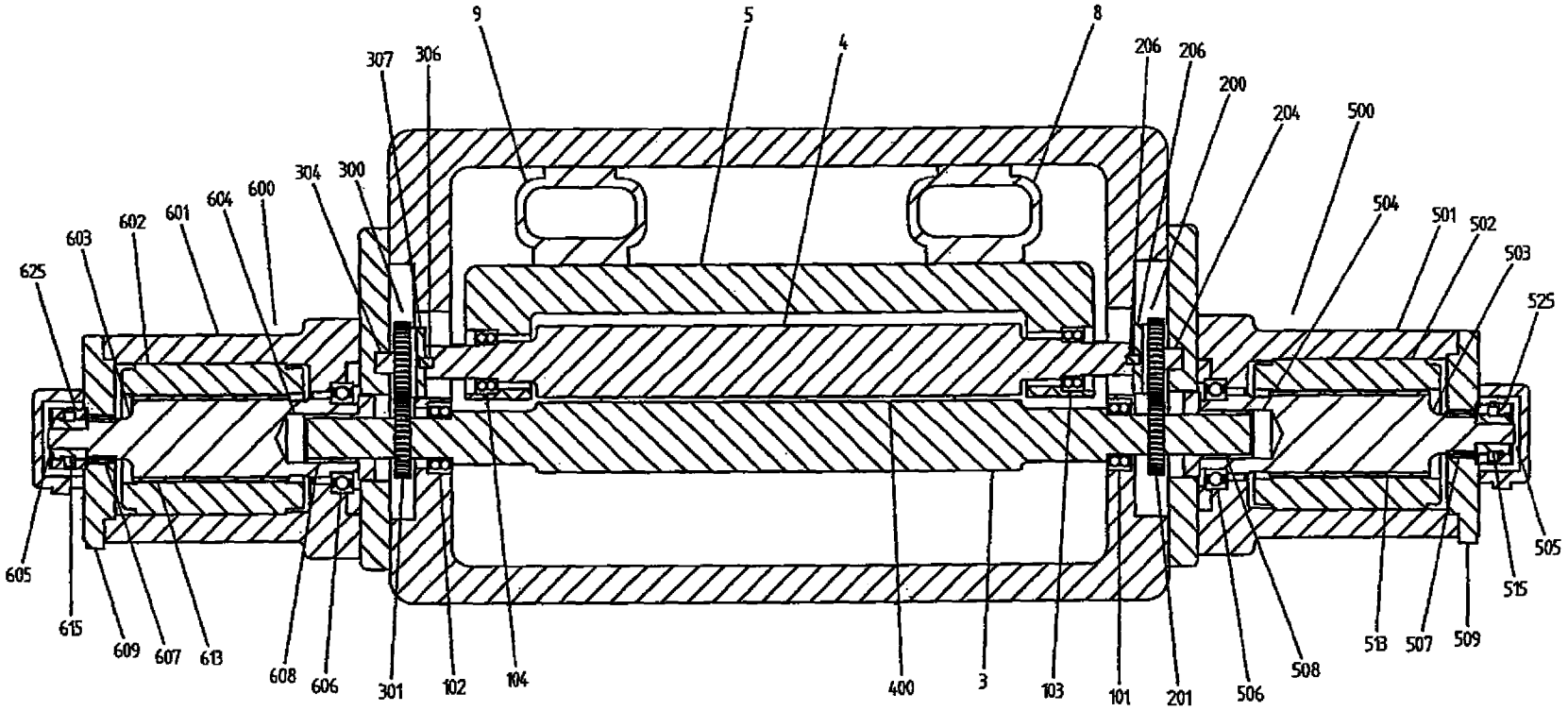
FIG. 3 is a section view of a roll type material feeding apparatus according to an embodiment of the invention as taken substantially along lines A-A of FIG. 2.

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the invention. However, because such elements are known in the art, and because they do not facilitate a better understanding of the present invention, a discussion of such elements is not provided herein. The detailed description will be provided herein below with reference to the attached drawings.

For purposes of the description hereinafter, the terms "upper", "lower", "vertical", "horizontal", "axial", "top", "bottom", and derivatives thereof shall relate to the invention, as it is oriented in the drawings. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

An embodiment in accordance with the present invention will be described below with reference to the accompanying drawings. FIGS. 1-7 show a structure of a feeding apparatus with an embodiment of the present invention. The described embodiment of the roll type feeding apparatus feeds a workpiece such as metal strip or sheets, or the like to a press machine, stamping machine or the like. It should be understood that the roll type feeding apparatus may be used with other materials or in combination with other types of machines requiring the intermittent feeding of a workpiece.

A feeding apparatus 1, depicted generally in FIG. 1, is provided with a frame 2.

A first driven feed roll 3 is rotatably supported in frame 2 by bearings 101 and 102.

A first drive motor 500 is operatively connected to a first end of driven feed roll shaft 3. A second drive motor 600 is operatively coupled to the end of driven feed roll shaft 3 opposite the first drive motor 500. First and second drive motors 500 and 600 are preferably permanent magnet brushless servo motors.

Figure 4:
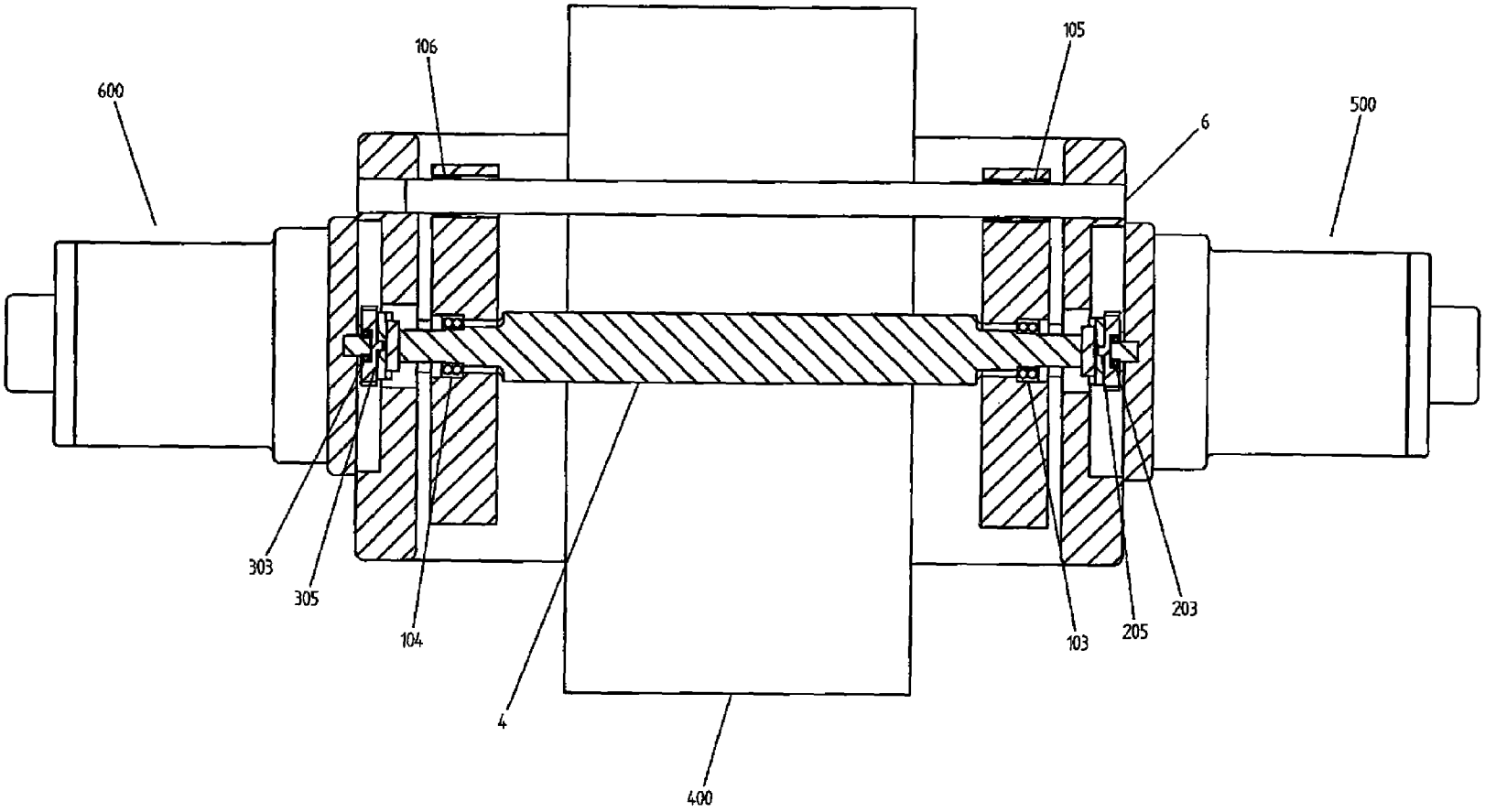
FIG. 4 is a section view of a roll type material feeding apparatus according to an embodiment of the invention as taken substantially along lines B-B of FIG. 2.

A second feed roll 4 is arranged substantially parallel to first driven feed roll 3, and rotatably supported in a movable roll support 5 by bearings 103,104. Movable roll support 5 is rotatably supported on pivot shaft 6 by bearings 105 and 106 (FIG. 4). Pivot shaft 6 is fixedly mounted to frame 2.

In the illustrated embodiment, second feed roll 4 is also a driven roll via first and second generally depicted transmission arrangements 200 and 300.

Workpiece 400 is illustrated between first driven feed roll 3 and second feed roll 4.

Force generating actuators 8 and 9 are mounted between frame 2 and movable roll support 5. In this embodiment, force generating actuators 8 and 9 are depicted as flexible bladder type pneumatic actuators. Force generating actuators 8 and 9 cooperate with movable roll support 5 to generate a gripping force between second feed roll 4 and first driven feed roll 3 for gripping workpiece 400 there between. While force generation actuators 8 and 9 are depicted as flexible bladder type pneumatic actuators, it should be understood that any actuators capable of force generation should be considered within the scope of the present invention. Such actuators include but are not limited to, pneumatic or hydraulic cylinders, motor and screw type actuators, linear motors, etc.

A first drive motor 500 (FIG. 3) comprises a housing 501, stationary winding arrangement 502, a motor rotor shaft 503 with hollow end 504, permanent magnets 513, an end plate 509, and a rotary positional feedback device 505.

First drive motor housing 501 is rigidly attached to frame 2.

Stationary winding arrangement 502 and end plate 509 are fixedly attached to motor housing 501. Permanent magnets 513 are fixedly attached to motor rotor shaft 503 which is rotatably supported in housing 501 and end plate 509 by bearings 506 and 507 respectively.

Hollow end 504 of first drive motor rotor shaft 503 is arranged for driving engagement with first driven feed roll shaft 3 via keyless frictional coupling member 508.

Rotary positional feedback device 505 is preferably a sensor. In the present embodiment, rotary positional feedback device 505 is a synchronous resolver and comprises a feedback device rotor 515 and a feedback device stator 525. Feedback device rotor 515 is fixedly attached to motor rotor shaft 503 for rotation therewith. Feedback device stator 525 is fixedly attached to end plate 509.

The described cooperating arrangement of components provide for the sensing by rotary feedback device 505 the relative rotary position of motor rotor shaft 503 and stationary winding arrangement 502 as well as the relative rotary position of driven feed roll shaft 3 and frame 2.

Second drive motor 600 comprises a housing 601, stationary winding arrangement 602, a motor rotor shaft 603 with hollow end 604, permanent magnets 613, an end plate 609, and rotary positional feedback device 605.

Second drive motor housing 601 is rigidly attached to frame 2.

Stationary winding arrangement 602 and end plate 609 are fixedly attached to motor housing 601. Permanent magnets 613 are fixedly attached to motor rotor shaft 603 which is rotatably supported in housing 601 and end plate 609 by bearings 606 and 607 respectively.

Hollow end 604 of second drive motor rotor shaft 603 is arranged for driving engagement with first driven feed roll shaft 3 via keyless frictional coupling member 608.

Rotary positional feedback device 605 is preferably a sensor. In the present embodiment, rotary positional feedback device 605 is a synchronous resolver and comprises a feedback device rotor 615 and a feedback device stator 625. Feedback device rotor 615 is fixedly attached to motor rotor shaft 603 for rotation therewith. Feedback device stator 625 is fixedly attached to end plate 609.

The described cooperating arrangement of components provide for the sensing by rotary feedback device 605 the relative rotary position of motor rotor shaft 603 and stationary winding arrangement 602 as well as the relative rotary position of driven feed roll shaft 3 and frame 2.

While this embodiment depicts drive motor rotor shafts 503 and 603 as having hollow ends 504 and 604 respectively and coupling members 508 and 608 as frictional keyless couplings to facilitate quick removal of drive motors 500 and 600, it should be understood that any combination of shaft ends of drive motor rotor shafts 503 and 603 and driven feed roll shaft 3 in driving engagement should be considered within the scope of the present invention. Such configurations may include but are not limited to; key and setscrew arrangements, rigid type shaft couplings, bellows type flexible couplings, flexible beam type couplings, split shaft and shaft collar arrangements, keyless hub couplings, etc.

Figure 5:
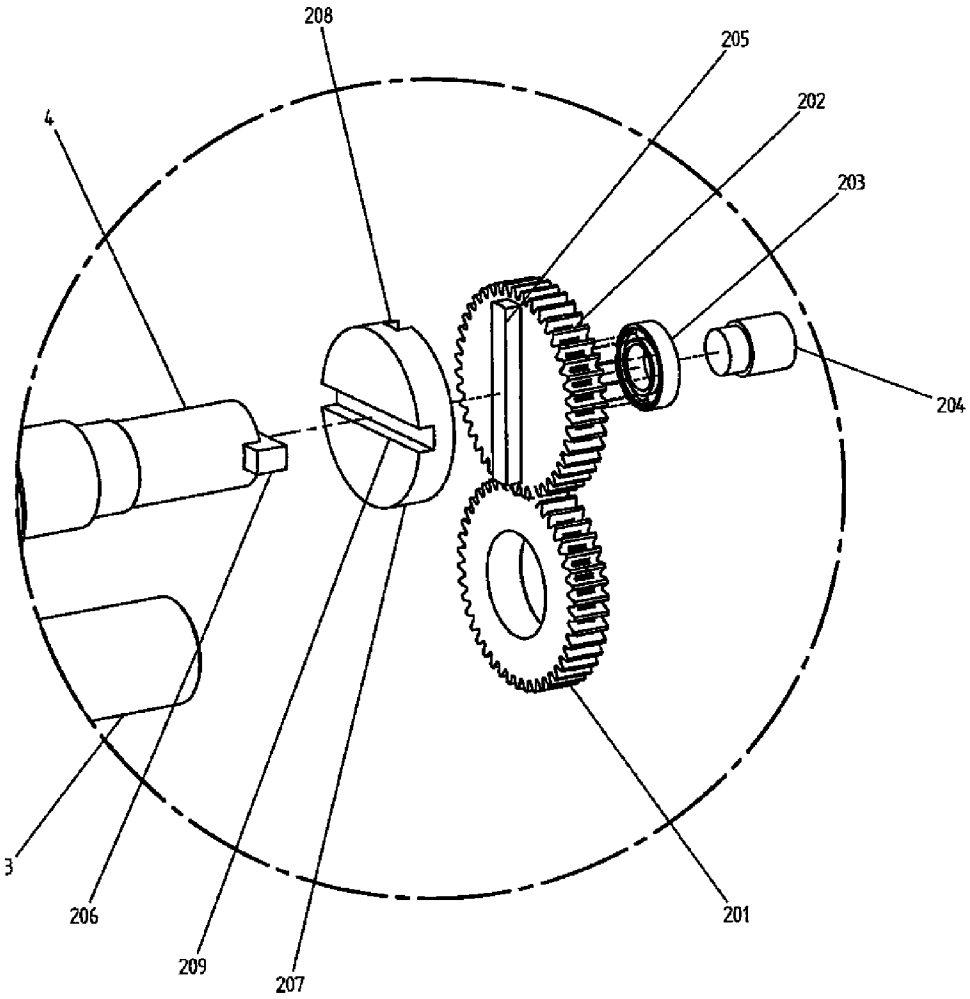
FIG. 5 is a partial exploded view of a roll type material feeding apparatus according to an embodiment of the invention.

FIG. 5 illustrates in detail generally depicted transmission arrangement 200. The aforementioned transmission arrangement 300 is of symmetrical design. Accordingly, FIG. 5 can also be considered to be illustrative of transmission arrangement 300.

Transmission arrangement 200 includes drive gear 201 which is rigidly attached to driven feed roll shaft 3 for rotation therewith. Transmission arrangement 200 also includes driven gear 202 in driving engagement with drive gear 201 and which is rotatably supported by bearing 203. Bearing 203 is supported by support pin 204 which is fixedly mounted to frame 2. Driven gear 202 includes a drive key 205. Drive key 205 is shown as an integral part of driven gear 202, however it should be noted that drive key 205 could be a separate component which is fixedly attached to driven gear 202.

Transmission arrangement 200 further includes a driven key 206 which is fixedly attached to second feed roll 4. Transmission arrangement 200 still further includes a center coupling 207. Center coupling 207 includes drive key slot 208 and driven key slot 209. Drive key slot 208 and driven key slot 209 are in sliding contact and in driving engagement with drive key 205 and driven key 206 respectively. Drive key 205 and drive key slot 208 are arranged perpendicular to driven key 206 and driven key slot 209. Such arrangement of drive elements 205 and 208 arranged perpendicular to the driven elements 206 and 209 allows for radial movement of the second feed roll 4 while maintaining driving engagement of gears 201 and 202 without introducing clearance and backlash there-between. Radial movement of second feed roll 4 is required to accommodate different thicknesses of workpiece 400 or for opening and closing of the second feed roll 4 to facilitate loading of the workpiece 400 to the machine.

While the depicted embodiment of the invention depicts drive key 205 attached to driven gear 202 in sliding contact and driving engagement with center coupling key slot 208 and driven key 206 attached to second feed roll 4 in sliding contact and driving engagement with center coupling key slot 209, it should be noted that the keys and key slots could be easily interchanged. All combinations of keys, key slots, and center coupling arrangements wherein the drive elements are arranged perpendicular to the driven elements should be considered within the scope of the present invention.

Transmission arrangements 200 and 300 are arranged for driving the second feed roll 4 in cooperation with the first driven feed roll 3 such that the transmission ratios of the first and second transmission arrangements 200 and 300 are equal to the ratio of the diameters of the first driven feed roll 3 and the second feed roll 4.

Figure 6:
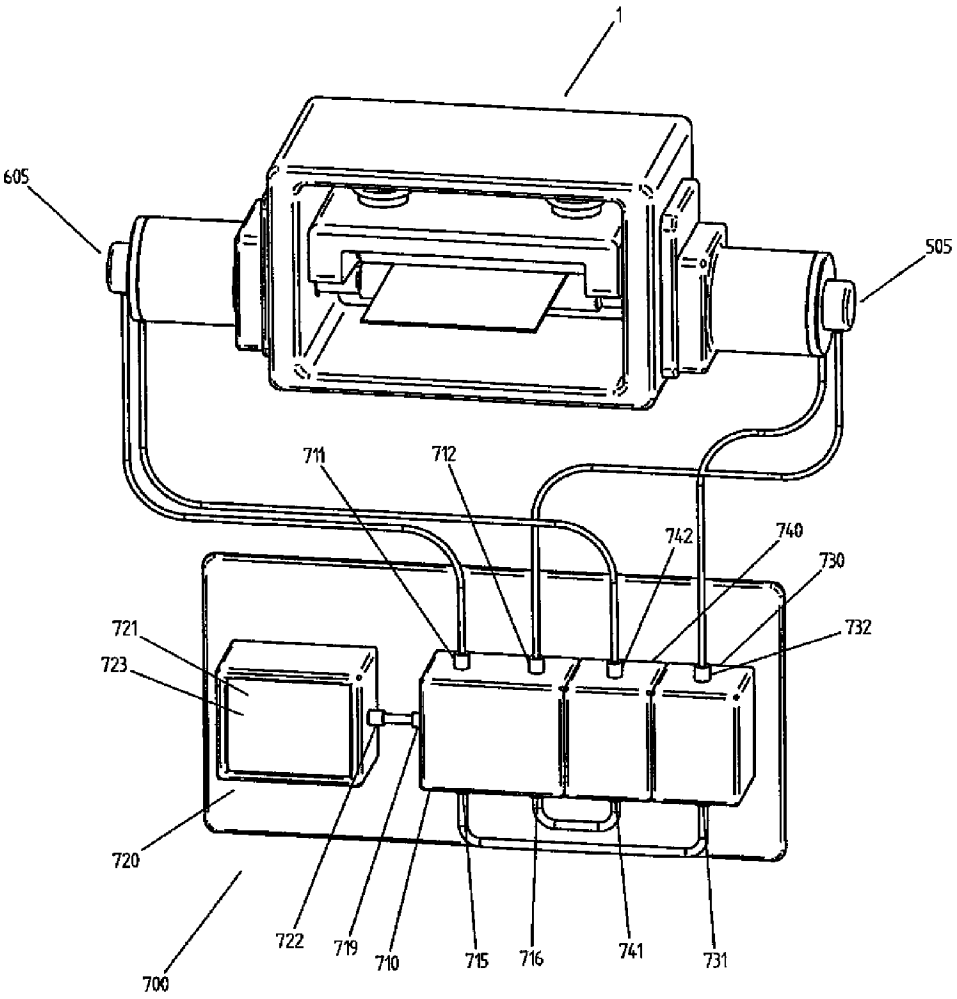
FIG. 6 is a schematic representation of an embodiment of a roll type material feeding apparatus according to an, embodiment of the invention.

FIG. 6 illustrates feeding apparatus 1 with connections to control device 700. Control system 700 comprises motion controller 710, human machine interface 720, servo drive 730, and a servo drive 740.

Motion controller 710 includes inputs 711 and 712 for accepting signals from rotary position feedback devices 505 and 605 respectively. Motion controller 710 also includes outputs 715 and 716 for generating command signals to servo drives 730 and 740 respectively. Motion controller 710 further includes a communication input 719 for accepting data from human machine interface 720.

Human machine interface 720 includes a display device 721 for communicating information to a human operator, a communications output 722 for outputting data to motion controller 710, and an input system 723 for accepting input from a human operator. Human operator input parameters may include but are not limited to: desired index distance, feeding device feed length, roll gripping force, desired timing relationship with the press such a intermittent feeding action start time and intermittent feeding action end time, etc. In the context of the invention the feeding action start and end times are commonly described in terms of the stamping machine crankshaft angle. For simplicity, the stamping machine and stamping machine crankshaft have not been illustrated as these are common and well known in the art.

In the depicted embodiment, input system 723 is a touch screen interface. It should be understood that any input system capable of accepting input from a human operator should be considered within the scope of the present invention. Such input systems include but are not limited to; computer keyboards, computer pointing devices such as a computer mouse or touch-pad, digital thumb-wheels, etc.

Servo drives 730 and 740 include inputs 731 and 741 respectively for accepting command signals from motion controller 710. Servo drives 730 and 740 further include outputs 732 and 742 for energizing servo motors 500 and 600 respectively. Outputs 732 and 742 are preferably 3 phase outputs which are 120 degrees displaced from each other. Such 3 phase motor outputs are well known in the art for the energizing of permanent magnet brushless servo motors.

Motion controller 710 processes the human operator input data from communications input 719 and the rotary position data from inputs 711 and 712 to generate command outputs 715 and 716. Processing algorithms performed by motion controller 710 may include but are not limited to; closed loop velocity control, closed loop position control, individual motor commutation algorithms, feed forward control algorithms, motion profile generation, field weakening algorithms, etc.

Figure 7:
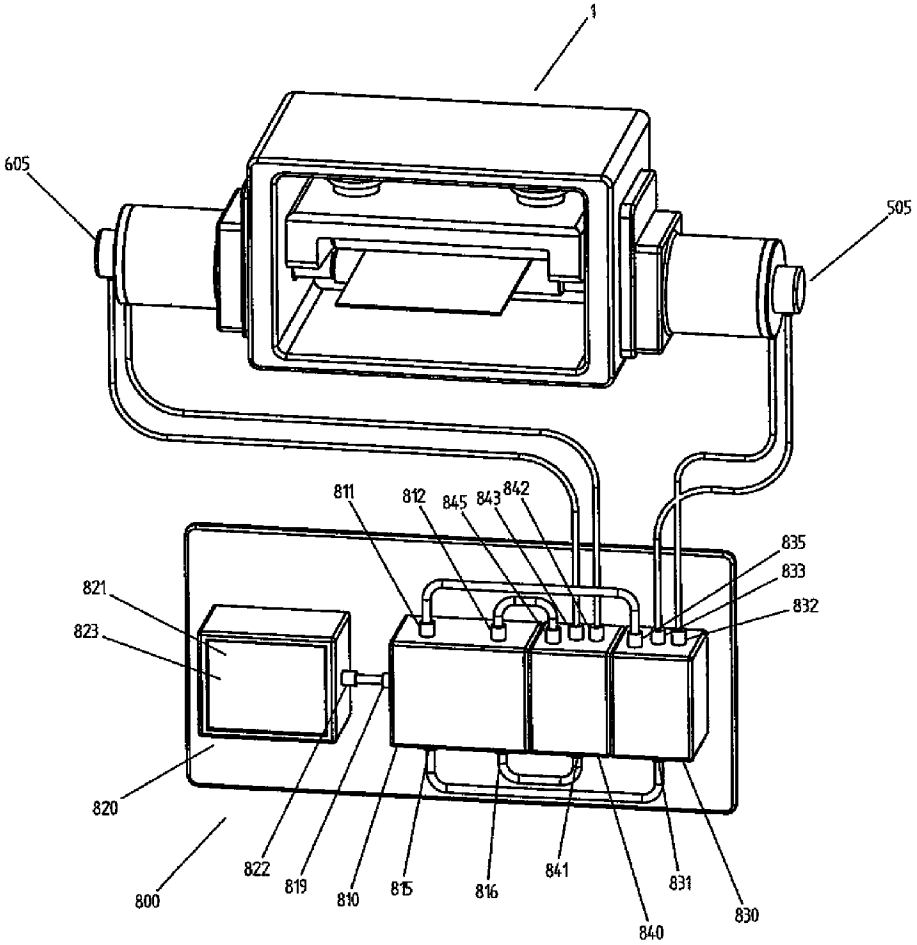
FIG. 7 is a schematic representation of another embodiment of a roll type material feeding apparatus according to an embodiment of the invention.

FIG. 7 illustrates feeding apparatus 1 with connections to alternative control device 800. Control system 800 comprises motion controller 810, human machine interface 820, servo drive 830, and servo drive 840.

Motion controller 810 includes inputs 811 and 812 for accepting communications signals from servo drives 830 and 840 respectively. Motion controller 810 also includes outputs 815 and 816 for generating command signals to servo drives 830 and 840 respectively. Motion controller 810 further includes a communication input 819 for accepting data from human machine interface 820.

Human machine interface 820 includes a display device 821 for communicating information to a human operator, a communications output 822 for outputting data to motion controller 810, and an input system 823 for accepting input from a human operator. Human operator input parameters may include but are not limited to; feeding device feed length, roll grip force, intermittent feeding action start time, intermittent feeding action end time, etc. In the context of the invention the feeding action start and end times are commonly described in terms of the stamping machine crankshaft angle. For simplicity, the stamping machine and stamping machine crankshaft have not been illustrated as these are common and well known in the art.

In the depicted embodiment, input system 823 is a touch screen interface. It should be understood that any input system capable of accepting input from a human operator should be considered within the scope of the present invention. Such input systems include but are not limited to; computer keyboards, computer pointing devices such as a computer mouse or touch-pad, digital thumb-wheels, etc.

Servo drives 830 and 840 include inputs 831 and 841 respectively for accepting command signals from motion controller 810. Servo drives 830 and 840 also include outputs 832 and 842 for energizing servo motors 500 and 600 respectively. Outputs 832 and 842 are preferably 3 phase outputs which are 120 degrees displaced from each other. Such 3 phase motor outputs are well known in the art for the energizing of permanent magnet brushless servo motors.

Servo drives 830 and 840 further include inputs 833 and 843 for accepting signals from rotary position feedback devices 505 and 605 respectively. Servo drives 830 and 840 further include communication outputs 835 and 845 respectively for communicating data to motion controller 810. Servo drives 830 and 840 process the rotary position feedback data from inputs 833 and 843 respectively, the command signals of inputs 831 and 841 respectively to generate energizing outputs 832 and 842 respectively. Processing algorithms of servo drives 830 and 840 may include but are not limited to; closed loop current control, closed loop velocity control, closed loop position control, motor commutation algorithms, field weakening algorithms, etc.

In this embodiment, servo drives 830 and 840 communicate unprocessed data, partially processed data, or fully processed data to the motion controller 810 via communications outputs 835 and 845 respectively. Communications data may include but is not limited to; rotary position data, motor winding currents, motor speed, etc.

Motion controller 810 processes the human operator input data from communications input 819 and communications data from inputs 811 and 812 to generate command outputs 815 and 816. Processing algorithms performed by motion controller 810 may include but are not limited to; closed loop velocity control, closed loop position control, individual motor commutation algorithms, feed forward control algorithms, motion profile generation, field weakening algorithms, etc.

As discussed above, although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor; and a first transmission apparatus arranged for driving said second feed roll in cooperation with said first driven feed roll such that the transmission ratio of the first transmission apparatus is equal to the ratio of the diameters of the first driven feed roll and the second feed roll;

wherein the first transmission apparatus includes:

a first drive gear attached to the first driven feed roll shaft;

a first driven gear arranged in driving arrangement with the first drive gear;

a first intermediate coupling member for coupling said first driven gear to said second feed roll;

a first drive key and a first drive key slot in sliding engagement with each other; and a first driven key and a first driven key slot in sliding engagement with each other;

wherein said first driven gear includes one of said first drive key and said first drive key slot, and wherein said coupling member includes the other one of said first drive key and said first drive key slot;

wherein said second feed roll includes one of said first driven key and said first driven key slot, and wherein said coupling member includes the other one of said first driven key and said first driven key slot;

wherein said first drive key and said first drive key slot are configured to transfer rotational motion from said first drive key and said first drive key slot to said first driven key and said first driven key slot.

2. The apparatus of claim 1, wherein the first and second drive motors are permanent magnet brushless servo motors.

3. The apparatus of claim 1, wherein the first and second drive motors are arranged in frictional driving engagement with the first driven feed roll shaft.

4. The apparatus of claim 1, wherein the first and second drive motors are arranged for disengagement with the first driven feed roll shaft for installation and removal.

5. The apparatus of claim 1, further comprising a second rotary position sensor arranged to rotate cooperatively with said second drive motor.

6. The apparatus of claim 5, further comprising:

a control device, a first servo drive and a second servo drive.

7. The apparatus of claim 6, wherein the control device further includes:

a first and second position sensor input for accepting position signals from the first and second rotary position sensors;

a first command signal output for sending a first command signal to the first servo drive; and a second command signal output for sending a second command signal to the second servo drive.

8. The apparatus of claim 7, wherein the first servo drive includes a first command signal input and a first output for energizing the first drive motor; and wherein the second servo drive includes a second command signal input and a second output for energizing the second drive motor.

9. The apparatus of claim 8, wherein the control device is capable of accepting input data from a human operator.

10. The apparatus of claim 9, wherein the data input is capable of being varied.

11. The apparatus of claim 9, wherein the input data includes a desired index distance.

12. The apparatus of claim 9, wherein the input data includes a desired timing relationship with a stamping machine.

13. The apparatus of claim 5, further comprising:

a first servo drive with a position sensor input for accepting a position signal from the first rotary position sensor and an output for energizing the first drive motor; and a second servo drive with a position sensor input for accepting a position signal from the first rotary position sensor and an output for energizing the second drive motor.

14. The apparatus of claim 1, wherein said first drive key and said first drive key slot are arranged perpendicular to said first driven key and said first driven key slot.

15. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor; and a first transmission apparatus arranged for driving said second feed roll in cooperation with said first driven feed roll such that the transmission ratio of the first transmission apparatus is equal to the ratio of the diameters of the first driven feed roll and the second feed roll; and a second transmission apparatus arranged for driving said second feed roll in cooperation with said first driven feed roll such that the transmission ratio of the second transmission apparatus is equal to the ratio of the diameters of the first driven feed roll and the second feed roll;

wherein the second transmission apparatus includes:

a second drive gear attached to the first driven feed roll shaft;

a second driven gear arranged in driving arrangement with the second drive gear;

a second intermediate coupling member for coupling said second driven gear to said second feed roll;

a second drive key and a second drive key slot in sliding engagement with each other; and a second driven key and a second driven key slot in sliding engagement with each other;

wherein said second driven gear includes one of said second drive key and said second drive key slot, and wherein said coupling member includes the other one of said second drive key and said second drive key slot;

wherein said second feed roll includes one of said second driven key and said second driven key slot, and wherein said coupling member includes the other one of said second driven key and said second driven key slot;

wherein said second drive key and second drive key slot are configured to transfer rotational motion from said second drive key and said second drive key slot to said second driven key and said second driven key slot.

16. The apparatus of claim 15, wherein said second drive key and said second drive key slot are arranged perpendicular to said second driven key and said second driven key slot.

17. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor;

a second rotary position sensor arranged to rotate cooperatively with said second drive motor;

a control device, a first servo drive and a second servo drive;

wherein the control device further includes:

a first and second position sensor input for accepting position signals from the first and second rotary position sensors;

a first command signal output for sending a first command signal to the first servo drive; and a second command signal output for sending a second command signal to the second servo drive;

wherein the first servo drive includes a first command signal input and a first output for energizing the first drive motor;

wherein the second servo drive includes a second command signal input and a second output for energizing the second drive motor; and wherein the first and second command signals include a commutation command.

18. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor;

a second rotary position sensor arranged to rotate cooperatively with said second drive motor;

a control device, a first servo drive and a second servo drive;

wherein the control device further includes:

a first and second position sensor input for accepting position signals from the first and second rotary position sensors;

a first command signal output for sending a first command signal to the first servo drive; and a second command signal output for sending a second command signal to the second servo drive;

wherein the first servo drive includes a first command signal input and a first output for energizing the first drive motor;

wherein the second servo drive includes a second command signal input and a second output for energizing the second drive motor; and wherein the first and second command signals include an electrical current command value.

19. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor;

a second rotary position sensor arranged to rotate cooperatively with said second drive motor;

a control device, a first servo drive and a second servo drive;

wherein the control device further includes:

a first and second position sensor input for accepting position signals from the first and second rotary position sensors;

a first command signal output for sending a first command signal to the first servo drive; and a second command signal output for sending a second command signal to the second servo drive;

wherein the first servo drive includes a first command signal input and a first output for energizing the first drive motor;

wherein the second servo drive includes a second command signal input and a second output for energizing the second drive motor; and wherein the outputs of the first and second servo drives for energizing the first and second drive motors are 3-phase outputs; and wherein the first and second servo drives utilize the first and second command signals of the control device for the independent commutation of the first and second drive motors respectively.

20. An apparatus for the intermittent feeding of a workpiece, the apparatus comprising:

a frame:

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor;

a second rotary position sensor arranged to rotate cooperatively with said second drive motor;

a first servo drive with a position sensor input for accepting a position signal from the first rotary position sensor and an output for energizing the first drive motor;

a second servo drive with a position sensor input for accepting a position signal from the first rotary position sensor and an output for energizing the second drive motor;

wherein the outputs of the first and second servo drives for energizing the first and second drive motors are 3-phase outputs; and wherein the first and second servo drives utilize the position signal of the first and second rotary position sensors for independent commutation of the first and second drive motors respectively.

21. An apparatus for the intermittent feeding of a workpiece, the apparatus comprising:

a frame;

a first driven feed roll supported by said frame, wherein said first driven feed roll comprises a first driven feed roll shaft having a first end and a second end opposite thereto;

a second feed roll supported by said frame and arranged substantially parallel to said first driven feed roll;

a first drive motor arranged to rotate in driving engagement with said first end of said first driven feed roll shaft;

a second drive motor arranged to rotate in driving engagement with said second end of said first driven feed roll shaft;

a first rotary position sensor arranged to rotate cooperatively with said first motor;

a second rotary position sensor arranged to rotate cooperatively with said second drive motor;

a first servo drive with a position sensor input for accepting a position signal from the first rotary position sensor and an output for energizing the first drive motor;

a second servo drive with a position sensor input for accepting a position signal from the first rotary position sensor and an output for energizing the second drive motor;

wherein the first servo drive further includes a command signal input and communications signal output, and wherein the second servo drive further includes a command signal input and a communications signal output;

a control device comprising;

a first and second communications signal input for accepting communications signals from first and second servo drive communications signal output respectively, a first and second command signal output connected to the command signal input of the first and second servo drives respectively.

22. The apparatus of claim 21, wherein the control device is capable of accepting input data from a human operator.

23. The apparatus of claim 22, wherein the data input is capable of being varied.

24. The apparatus of claim 22, wherein the input data includes a desired index distance.

25. The apparatus of claim 22, wherein the input data includes a desired timing relationship with a press.

* * * * *